US009327957B2

(12) United States Patent
Orita

(10) Patent No.: US 9,327,957 B2
(45) Date of Patent: May 3, 2016

(54) WATER DISPENSER

(75) Inventor: Yoshinori Orita, Kakogawa (JP)

(73) Assignee: KABUSHIKI KAISHA COSMO LIFE, Osaka (JP)

( * ) Notice: Subject to any disclaimer, the term of this patent is extended or adjusted under 35 U.S.C. 154(b) by 0 days.

(21) Appl. No.: 14/373,644

(22) PCT Filed: Jul. 3, 2012

(86) PCT No.: PCT/JP2012/066969

§ 371 (c)(1),
(2), (4) Date: Sep. 3, 2014

(87) PCT Pub. No.: WO2013/121599

PCT Pub. Date: Aug. 22, 2013

(65) Prior Publication Data

US 2015/0083250 A1 Mar. 26, 2015

(30) Foreign Application Priority Data

Feb. 14, 2012 (JP) ..... 2012-029210

(51) Int. Cl.
*B67D 1/00* (2006.01)
*B67D 3/00* (2006.01)
*F17D 1/08* (2006.01)

(52) U.S. Cl.
CPC ..... *B67D 1/0004* (2013.01); *B67D 3/0009* (2013.01); *B67D 3/0022* (2013.01); (Continued)

(58) Field of Classification Search
CPC .. B67D 1/0004; B67D 3/0022; B67D 2/0038; B67D 3/009; B67D 3/0032; B67D 3/0038; B67D 3/00323; F17D 1/08; Y10T 137/86035
USPC ..... 222/146.1, 148, 190
See application file for complete search history.

(56) References Cited

U.S. PATENT DOCUMENTS 4,030,634 A * 6/1977 Osborn ..... 222/23
4,958,747 A * 9/1990 Sheets ..... 222/67
(Continued)

FOREIGN PATENT DOCUMENTS

CN 2407692 11/2000
CN 1516676 7/2004
(Continued)

OTHER PUBLICATIONS

International Search Report issued Sep. 18, 2012 in International (PCT) Application No. PCT/JP2012/066969.
(Continued)

*Primary Examiner* — Kevin P Shaver
*Assistant Examiner* — Robert Nichols, II
(74) *Attorney, Agent, or Firm* — Wenderoth, Lind & Ponack, L.L.P.

(57) ABSTRACT

A water dispenser is proposed of which a raw water container is mounted upside down at the lower portion of a housing. The water dispenser has a piercing member which serves both as one end of a water supply line and one end of an air intake line. With this arrangement, when the raw water container is opened, the interior of the raw water container is simultaneously connected to the water supply line and the air intake line. Raw water containers can be easily exchanged. The raw water container is made of a soft material, so that air can be freely sucked into the raw water container through the air intake line while a pump is activated. This allows the pump to lift water with a minimum force.

2 Claims, 5 Drawing Sheets

(52) U.S. Cl.
CPC ..... *B67D3/0032* (2013.01); *B67D 3/0038* (2013.01); *B67D 3/0083* (2013.01); *F17D 1/08* (2013.01); *Y10T 137/86035* (2015.04)

(56) References Cited

U.S. PATENT DOCUMENTS

| | | | | |
|---|---|---|---|---|
| 5,111,966 | A | 5/1992 | Fridman | |
| 5,577,638 | A * | 11/1996 | Takagawa | 222/185.1 |
| 5,716,113 | A | 2/1998 | Plourde | |
| 6,442,960 | B1 | 9/2002 | Fournier et al. | |
| 7,669,738 | B1 * | 3/2010 | Byers | 222/164 |
| 8,356,731 | B2 * | 1/2013 | Xiao et al. | 222/67 |
| 8,500,993 | B2 * | 8/2013 | Davis | 210/104 |
| 2006/0071029 | A1 * | 4/2006 | Orita | 222/185.1 |
| 2010/0116847 | A1 * | 5/2010 | Foroughi et al. | 222/81 |
| 2012/0000861 | A1 | 1/2012 | Shiotani et al. | |
| 2012/0055953 | A1 | 3/2012 | Shiotani et al. | |
| 2014/0255257 | A1 * | 9/2014 | Pawlow | 422/114 |

FOREIGN PATENT DOCUMENTS

| | | |
|---|---|---|
| CN | 2675580 | 2/2005 |
| FR | 2 785 601 | 5/2000 |
| JP | 2001-153523 | 6/2001 |
| JP | 2006-341915 | 12/2006 |
| JP | 2010-052752 | 3/2010 |
| JP | 2010-143600 | 7/2010 |
| JP | 2010-173679 | 8/2010 |
| JP | 2010-228807 | 10/2010 |
| JP | 4802299 | 10/2011 |
| WO | 00/27744 | 5/2000 |
| WO | 02/102706 | 12/2002 |

OTHER PUBLICATIONS

European Search Report issued Oct. 16, 2015 in corresponding European Application No. 12868353.9.
Chinese Office Action issued Sep. 29, 2015 in corresponding Chinese Application No. 2012800695620 (with English translation).

* cited by examiner

WATER DISPENSER

TECHNICAL FIELD

This invention relates to a water server (i.e., water dispenser) which can discharge water that has been moved to a water storage tank from an exchangeable raw water container as drinking water.

BACKGROUND ART

Water dispensers are configured such that when a user operates a lever or a cock, thereby opening a valve, water in the water storage tank is discharged through a water discharge line, and is received in e.g. a user's cup. One of such water dispensers includes a raw water container provided at the lower portion of the housing, and a water storage tank provided at a higher position than the raw water container. This type of water dispenser is advantageous in that when exchanging the used raw water container with a new one, a user or an operator does not have to lift the new raw water container to a high place. Since the water storage tank is provided at a higher position than the raw water container, this water dispenser includes a water supply line in which a pump is provided to lift water in the raw water container into the water storage tank through the water supply line. When water in the water supply tank decreases, the pump is automatically activated to lift water in the raw water container into the water supply tank until the water in the water storage tank increases to a predetermined amount (see e.g. Japanese Patent 4802299B and Japanese Patent Publication 2001-153523A).

A water dispenser of the type in which the raw water container is placed upside down includes a piercing member which is configured to push up the plug of the raw water container with the container placed upside down. The water supply line has an end portion which is a portion of the piercing member. Most ordinarily, by lowering the raw water container with the plug in contact with piercing member, the plug is pushed up into the container. However, in another arrangement, as in Japanese Patent 4802299B, a piercing member is lifted with the raw water container kept stationary to push in the plug. In either case, by piecing the piercing member through the plug, the raw water container is opened, and simultaneously, the interior of the container is connected to the water supply line.

In the water dispenser disclosed in Japanese Patent 4802299B, since the raw water container, water supply line and water storage tank are connected together in a sealed arrangement, if a rigid container is used as the raw water container, it will be necessary for the pump to generate a large force in order to lift water in the raw water container. Thus, as described in paragraphs [0021] and [0022] of Japanese Patent Publication 2001-153523A, it is preferable to use a raw water container which is made of a soft material and collapsible as water remaining in the container decreases.

Even if a soft raw water container is used, however, in the arrangement in which the raw water container is placed upside down as in Japanese Patent 4802299B, when, with a reduction in water remaining in the container, the raw water container is collapsed such that its peripheral portion is folded until its height decreases to near the mouth of the container, the rigidity of the peripheral wall portion tends to become higher than the atmospheric pressure. Since the container is not collapsible thereafter, the load on the pump tends to increase.

SUMMARY OF THE INVENTION

In view of these circumstances, an object of the present invention is make it possible to exchange raw water containers as easily as possible, and simultaneously to minimize loads on the pump until the raw water container becomes empty.

In order to achieve this object, according to this invention, in a water dispenser in which the raw water container is placed upside down at the lower portion of the housing, and in which the water supply line has an end portion which is a portion of the piercing member, whereby the raw water container can be easily exchanged with a new one, the raw water container has a portion which is collapsible under the atmospheric pressure as water remaining in the raw water container decreases. With this arrangement, from immediately after exchanging raw water containers, the pump can lift water in the raw water container without generating a large force. Since the water dispenser further includes an air intake line through which atmospheric air can be freely sucked into the raw water container while the pump is activated, when water in the raw water container has been drawn up until the container is not collapsible any further, atmospheric air is spontaneously sucked into the raw water container through the air intake line by the amount equal to the amount of water that has been drawn up by the pump. Thus, the pump can lift water in the raw water container without generating a large force until the container becomes empty. The air intake line has an end portion which is a portion of the piercing member. With this arrangement, simultaneously when the raw water container is opened, the interior of the raw water container is connected to the air intake line, without the need for any additional work.

Preferably, the water dispenser further comprises a sterilizer provided in the air intake line and configured to mix sterilizing gas into atmospheric air in the air intake line with the sterilizer operatively associated with the pump. With this arrangement, since sterilizing gas is mixed into the air intake line every time the pump is activated, it is possible to prevent growth of bacteria in the air intake line and in the raw water container after atmospheric air has been sucked into the raw water container.

Preferably, the air intake line is a passage through which the interior of the raw water container is normally in communication with the atmosphere. With this arrangement, it is possible to eliminate the need to open and close the air intake line in operational association with the pump, and to detect the degree of contraction of the raw water container under the atmospheric pressure. In order not to take in atmospheric air into the air intake line near the ground level, the air intake line should be brought into communication with the atmosphere at a level higher than the level of the raw water container. Further, since the raw water container is always in communication with the atmosphere through this air intake line, the air intake line needs a vertically extending pipe portion extending to a position higher than the upper limit of the water level in the raw water container. With this arrangement, when the raw water container is set in position in the upside down position, water in the raw water container flows into the air intake line until the water level in the air intake line becomes equal to the water level in the raw water container. Thus, the portion of the vertically extending pipe located near the water level tends to especially become wet. By forming this pipe portion from copper, it is possible to prevent growth of bacteria on the surface of the pipe over a prolonged period of time due to the sterilizing action of copper itself.

The present invention provides a water dispenser comprising a housing, an exchangeable raw water container which has a plug and which can be set at a lower portion of the housing in an upside-down position, a water storage tank mounted in the housing at a position higher than the raw water container, a water supply line through which water in the raw water container can be drawn up into the water storage tank, a water discharge line through which water in the water storage tank can be discharged, and a piercing member configured to push up the plug of the raw water container when the raw water container is placed at the lower portion of the housing in the upside-down position, wherein the water supply line has an end portion which is a portion of the piercing member, characterized in that the raw water container is made of a soft material and has a portion which is collapsible under the atmospheric pressure when water remaining in the raw water container decreases, wherein the water dispenser further comprises an air intake line through which atmospheric air can be freely sucked into the raw water container while the pump is activated, and wherein the air intake line has an end portion which is a portion of the piercing member. With this arrangement, the raw water container can be set in position easily, and also it is possible to minimize the load on the pump until the raw water container becomes empty.

DETAILED DESCRIPTION OF THE INVENTION

Figure 1:
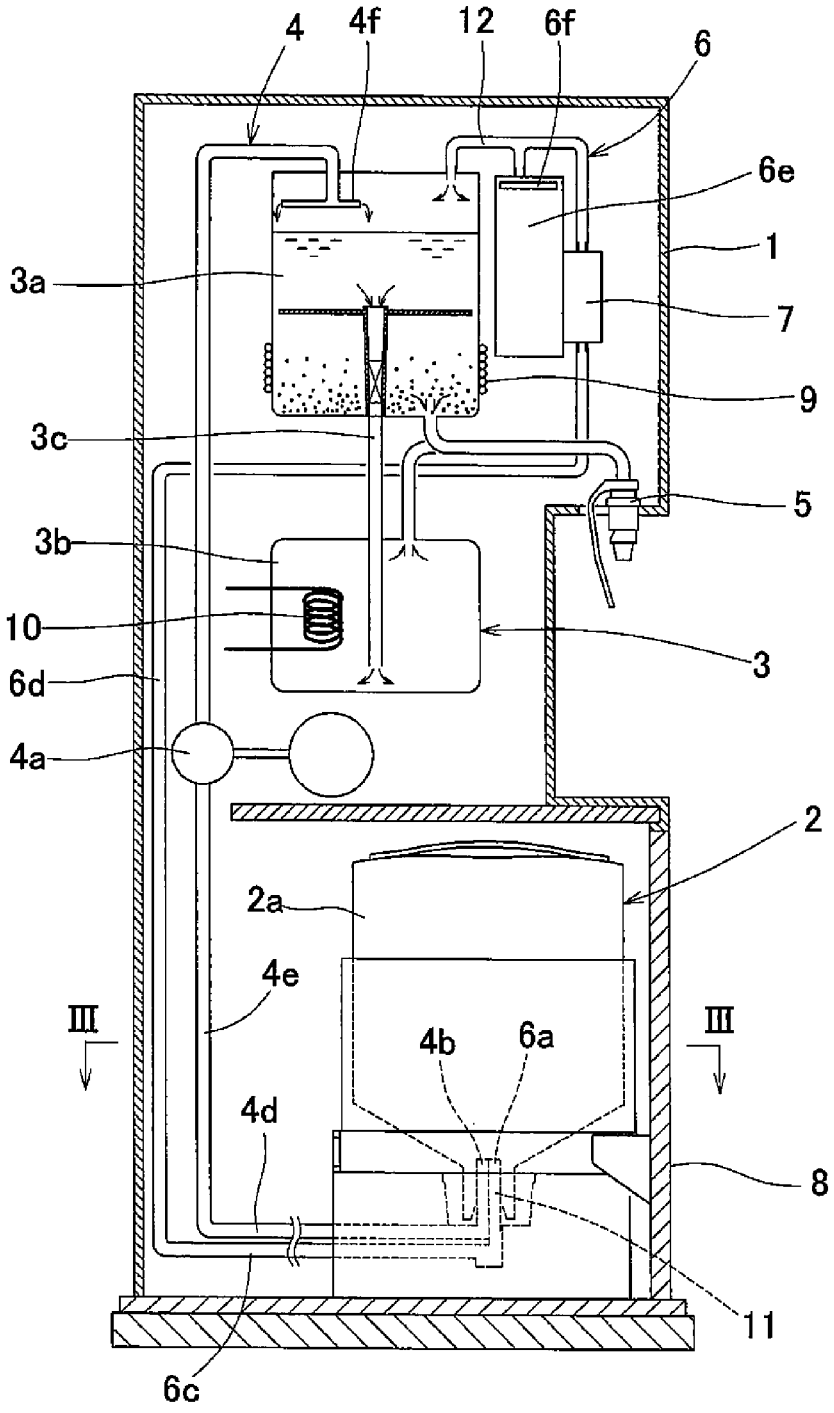
FIG. 1 schematically shows an entire water dispenser embodying the present invention.

A water dispenser embodying the present invention is described with reference to the accompanying drawings. As shown in FIGS. 1 to 4, the water dispenser includes an exchangeable raw water container 2 placed upside down at the lower portion of a housing 1. A water storage tank unit 3 is arranged in the housing 1 at a level higher than that of the raw water container 2. Water in the raw water container 2 is drawn up into the water storage tank unit 3 through a water supply line 4 by a pump 4*a*. Water in the water storage tank unit 3 is discharged through two water discharge lines 5. Atmospheric air can be freely introduced into the raw water container 2 through an air intake line 6 while the pump 4*a* is operating. The water dispenser further includes a sterilizer 7 for mixing sterilizing gas into the atmospheric air in the air intake line 6, and a slide table 8 which can be slid into the lower portion of the housing 1.

The housing 1 is a vertically elongated machine casing having a storage space at its lower portion into which the slide table 8 can be slid together with the raw water container 2. The lower portion of the housing 1 refers to its lower half portion up to half the height of the housing 1. The storage space of the housing 1 is covered by the front wall of the slide table 8 when the slide table 8 is fully slid into the storage space.

Figure 5:
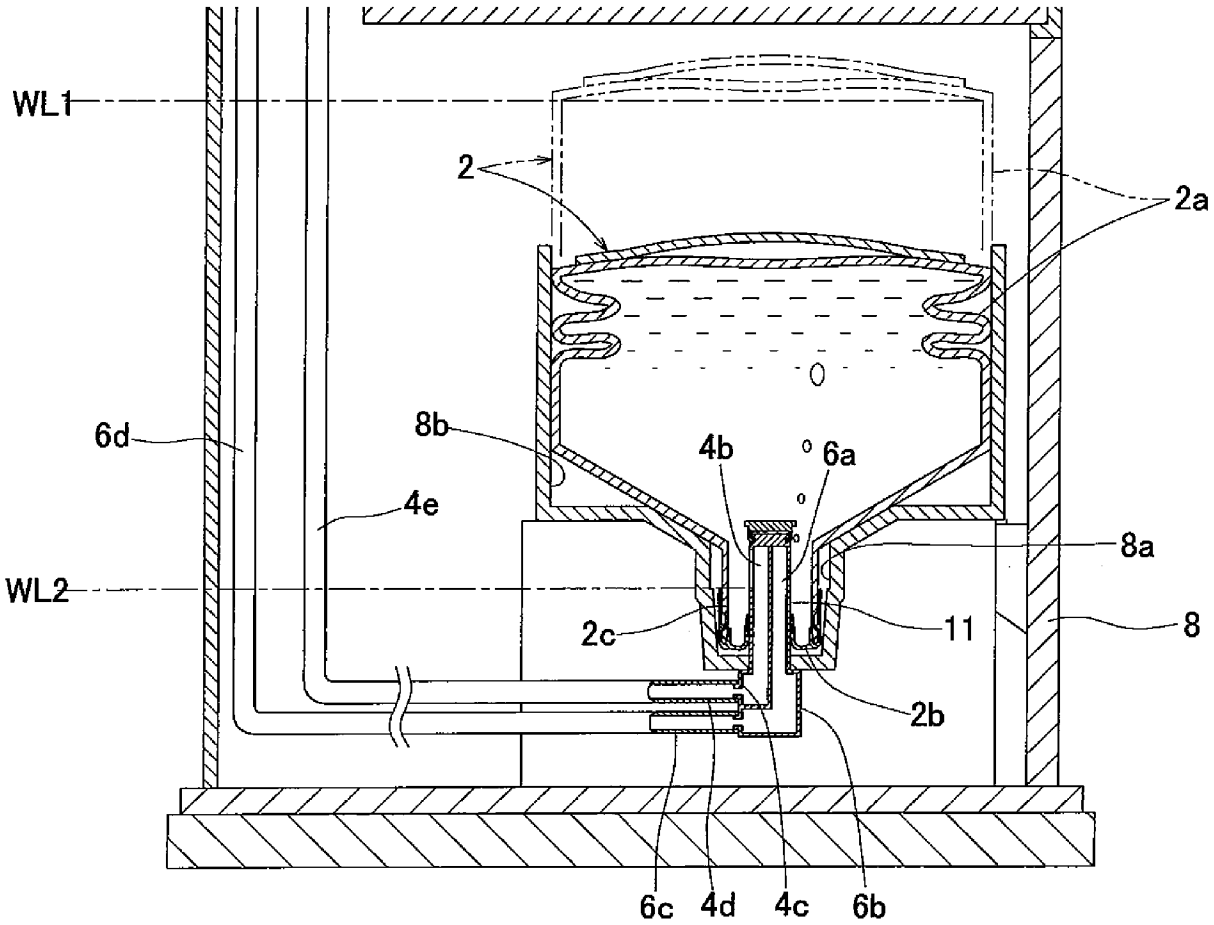
FIG. 5 is a partial sectional view of the water dispenser, showing the state in which a raw water container is not collapsible any further.

The raw water container 2 is made of a soft material and, as shown in FIG. 5, has a portion collapsible under the atmospheric pressure as the water in the container decreases. The raw water container 2 shown is formed by injection-molding a synthetic resin such that its side wall 2*a* is collapsible under the atmospheric pressure in a bellows-like manner so that its volume decreases while being kept upside down.

The water storage tank unit 3, shown in FIG. 1, is configured to adjust the temperature of water stored therein, and includes a cold water tank 3*a* having a heat exchanger 9 for cooling the water in the cold water tank 3*a*, a warm water tank 3*b* having a heater 10 for heating the water in the warm water tank 3*b*, and a water transfer line 3*c*. Raw water drawn up through the water supply line 4 is fed into the cold water tank 3*a*, and then flows into the warm water tank 3*b* through the water transfer line 3*c*. The two water discharge lines 5 are independent of each other with one of them connected to the cold water tank 3*a* and the other connected to the warm water tank 3*b*. Valves (not shown) are provided at the boundaries between the respective two water discharge lines 5 and the water storage tank unit 3 so that by opening one of the valves, a bottom portion of water in the cold water tank 3*a* or a top portion of water in the warm water tank 3*b* can be discharged into e.g. a cup. A baffle plate is mounted in the cold water tank 3*a* which interferes with downward flow of water supplied from the water supply line 4. One of the cold water tank and the warm water tank of the water storage tank unit 3 may be omitted.

For accurate positioning of the slide table 8 relative to the housing 1, the slide table 8 is coupled to a guide portion of the housing 1. The slide table 8 can be slid into and out of the housing in a horizontal straight line. The slide table 8 may be a carriage independent of the housing 1.

As shown in FIG. 5, the slide table 8 has a piercing member 11 which pushes up a plug 2*b* of the raw water container 2 with the container 2 placed upside down at the lower portion of the housing 1. As is apparent from FIGS. 2 and 4, with the slide table 8 placed outside the housing 1, the raw water container 2 can be placed upside down on the slide table 8 from over the piercing member 11. As shown in FIG. 5, the raw water container 2 has a vertical tubular mouth 2*c*, while the slide table 8 has a connecting mouth 8*a* into which the mouth 2*c* of the container 2 can be inserted. The mouth 2*c* of the container 2 and its surrounding portion are supported by a seat 8*b* of the slide table 8 both in the horizontal direction and in the vertical direction. When the mouth 2*c* of the raw water container 2 is inserted into the connecting mouth 8*a* with the container 2 in the upside-down position, the piercing member 11 is configured to abut the central portion of the plug 2*b*. Thus, as the raw water container 2 is lowered, the central portion of the plug 2*b* is pushed up into the container by the piercing member 11 until the mouth 2*c* of the container opens. After the mouth 2*c* opens, the raw water container 2 is adapted to be seated on the seat 8*b*. Supported by the seat 8*b*, the raw water container 2 is kept in the upside-down position until it becomes empty. With the plug 2*b* pushed in by the piercing member 11, its central portion is fitted around the distal end of the piercing member 11 protruding into the raw water container 2, with the remaining portion of the plug 2*b* attached to the mouth 2*c* of the raw water container 2. The piercing member 11 shown is a fixed type, but a movable one as disclosed in Japanese Patent 4802299B may be used instead.

As shown in FIGS. 1 and 5, the interior of the piercing member 11 is divided into two portions which form portions the water supply line 4 and the air intake line 6, respectively. Thus, the water supply line 4 and the air intake line 6 have respective first end portions 4*b* and 6*a* at the piercing member 11. The slide table 8 has a joint portion 4*c* communicating with the first end portion 4*b*, and a joint portion 6*b* communicating with the first end portion 6*a*. Connecting pipes 4*d* and 6*c* have their first ends connected to the respective joint portions 4*c* and 6*b*. The connecting pipes 4*d* and 6*c* are deformable following the movement of the slide table 8 relative to the housing. The connecting pipes 4*d* and 6*c* have their second ends connected to a first end of a water lifting pipe 4*e* and a first end of a vertical pipe 6*d*. Since the connecting pipes 4*d* and 6*c* are deformable following the movement of the slide table, the water supply line 4 and the air intake line 6 are not broken when the slide table 8 is slid in and out. Such connecting pipes 4*d* and 6*c* may be bellows pipes that can shrink and expand in the direction in which the slide table 8 is slid in and out, or flexible pipes.

As shown in FIG. 1, the water lifting pipe 4*e* extends to a level higher than the level of the cold water tank 3*a*. The water supply line 4 has a second end portion 4*f* at a level higher than a predetermined upper limit of the water level in the cold water tank 3*a*. The pump 4*a* is mounted at an intermediate portion of the water lifting pipe 4*e*, and may be e.g. a plunger pump or a gear pump. The pump 4*a* draws up water in the raw water container 2 through the water supply line 4 and supplies the thus drawn-up water into the cold water tank 3*a* in a shower or in droplets through the second end portion 4*f*. The pump 4*a* is actuated when a water level sensor detects that the water level in the cold water tank 3*a* is below a predetermined level.

The upwardly extending pipe 6*d* has a second end connected to an air chamber 6*e*. The air intake line 6 has a second end portion 6*f* which serves as an atmospheric air intake port of the air chamber 6*e* which communicates with the atmosphere in the housing 1. A filter such as an activated charcoal filter is mounted in the second end portion 6*f* of the air intake line 6 to remove pollutants contained in atmospheric air, such as dust, odors and bacteria, when atmospheric air passes therethrough.

The air intake line 6, through which the interior of the raw water container 2, in which raw water is stored, communicates with the atmosphere, comprises the first end portion 6*a*, joint portion 6*b*, connecting pipe 6*c*, vertically extending pipe 6*d*, and the second end portion 6*f*, which is located at the air chamber 6*e*. Through the air intake line 6, the interior of the raw water container 2 is always in communication with the atmosphere. Since the interior of the air intake line 6 and the interior of the water storage tank unit 3 are always at the atmospheric pressure, the water level in the vertically extending pipe 6*d* is always equal to the water level in the raw water container 2. FIG. 1 and the two-dot chain line of FIG. 5 show the state of the raw water container 2 in which the water levels in the raw water container 2, water supply line 4 and air intake line 6 have stabilized after setting the raw water container 2 upside down in the lower portion of the housing 1 and in which no water has been drawn up. In other words, FIG. 1 and the two-dot chain line of FIG. 5 show the state in which the water level in the raw water container 2, which is equal to the water level in the air intake line 6, is the highest. This water level is indicated by "WL1" in FIG. 5. The water level in the raw water container 2 at which no further water can be supplied from the container is indicated by "WL2" in FIG. 5. The water level WL2 corresponds to the lowest point of an opening formed in the first end portion 4*b* of the water supply line 4, which is located in the piercing member 11. In the example shown, in order to prevent the opening of the first end portion 4*b* from being closed by the plug 2*b* when the plug 2*b* is fitted around the top of the piercing member 11 and drops, the entire opening of the first end portion 4*b* is spaced apart from the raw water container 2. Thus, a small amount of water that cannot be supplied any further remains in the container as indicated by water level WL2. By providing the opening of the first end portion 4*b* substantially at the same level as the mouth 2*c* of the container 2, it is possible to reduce the amount of water that cannot be supplied from the container to substantially zero.

Since atmospheric air is sucked into the raw water container 2, any mass of water in the air intake line 6 disappears by the time the water level in the container 2 decreases to WL2. However, since the portion of the air intake line 6 below the water level WL1 tends to be wet, measures are preferably taken to prevent growth of bacteria at this portion of the air intake line 6. The portion of the air intake line 6 in which the water level becomes equal to the water level in the raw water container 2 extends between WL1 and WL2, and is a portion of the vertically extending pipe 6*d*. The portion of the vertically extending pipe 6*d* between WL1 and WL2 is made of copper. Since the water surface exists near this portion for a relatively long period of time until the raw water container 2 begins sucking air, this portion tends to become especially wet. But since this portion is made of copper, and copper itself has a sterilizing function, it is possible to prevent growth of bacteria on the surface of the copper pipe at this portion for a prolonged period of time. If the portion of the vertically extending pipe 6*d* up to the connecting point with the sterilizer 7, shown in FIG. 1, is made of copper, it is possible to more effectively prevent growth of bacteria.

The sterilizer 7 is configured to mix sterilizing gas into atmospheric air in the portion of the air intake line 6 higher than the portion of the air intake line 6 in which the water level becomes equal to the water level in the raw water container 2. Such sterilizing gas may be generated in the air intake line 6, or may be supplied into the air intake line 6 from outside the air intake line 6. If an ozone generator, which generates ozone from atmospheric air, is used as the sterilizer 7, it becomes unnecessary to replenish sterilizing gas. Such an ozone generator may be of the photochemical reaction type, which irradiates introduced atmospheric air with ultraviolet light, of the silent discharge type, which generates ozone by discharging electricity through introduced atmospheric air, of the corona discharge type, or of the composite discharge type, which is a combination of more than one discharge type.

The sterilizer 7 shown is configured to mix sterilizing gas with atmospheric air in the air chamber 6*e* too. A delay circuit is provided in the air chamber 6*e* so that atmospheric air introduced into the air chamber 6*e* is mixed with sterilizing air and stays therein. The delay circuit thus reduces bacteria in atmospheric air in the air chamber 6*e* and prevents growth of bacteria in the air chamber 6*e*.

An air introducing pipe 12 is connected to the water storage tank unit 3 at a level higher than the upper limit of the water level in the water storage tank unit 3. The air introducing pipe 12 is always in communication with the vertically extending pipe 6*d* and the air chamber 6*e*. When the water level in the water storage tank unit 3 falls, atmospheric air containing sterilizing gas which remains in the air chamber 6*e*, which is at the atmospheric pressure, is sucked into the water storage tank unit 3 through the air introducing pipe 12.

The sterilizer 7 is controlled in operative association with the pump 4*a*. Specifically, in the simplest arrangement, the pump 4*a* and the sterilizer may be configured such that when the pump 4*a* is switched on or off, the sterilizer 7 is simultaneously switched on or off. However, in order to keep the concentration of sterilizing gas to a suitable level, the sterilizer 7 may be programmed so as to be turned on and off based on a timer and/or on the concentration of sterilizing gas as detected, independently of the pump 4*a*.

(When Exchanging Raw Water Containers 2)

Figure 2:
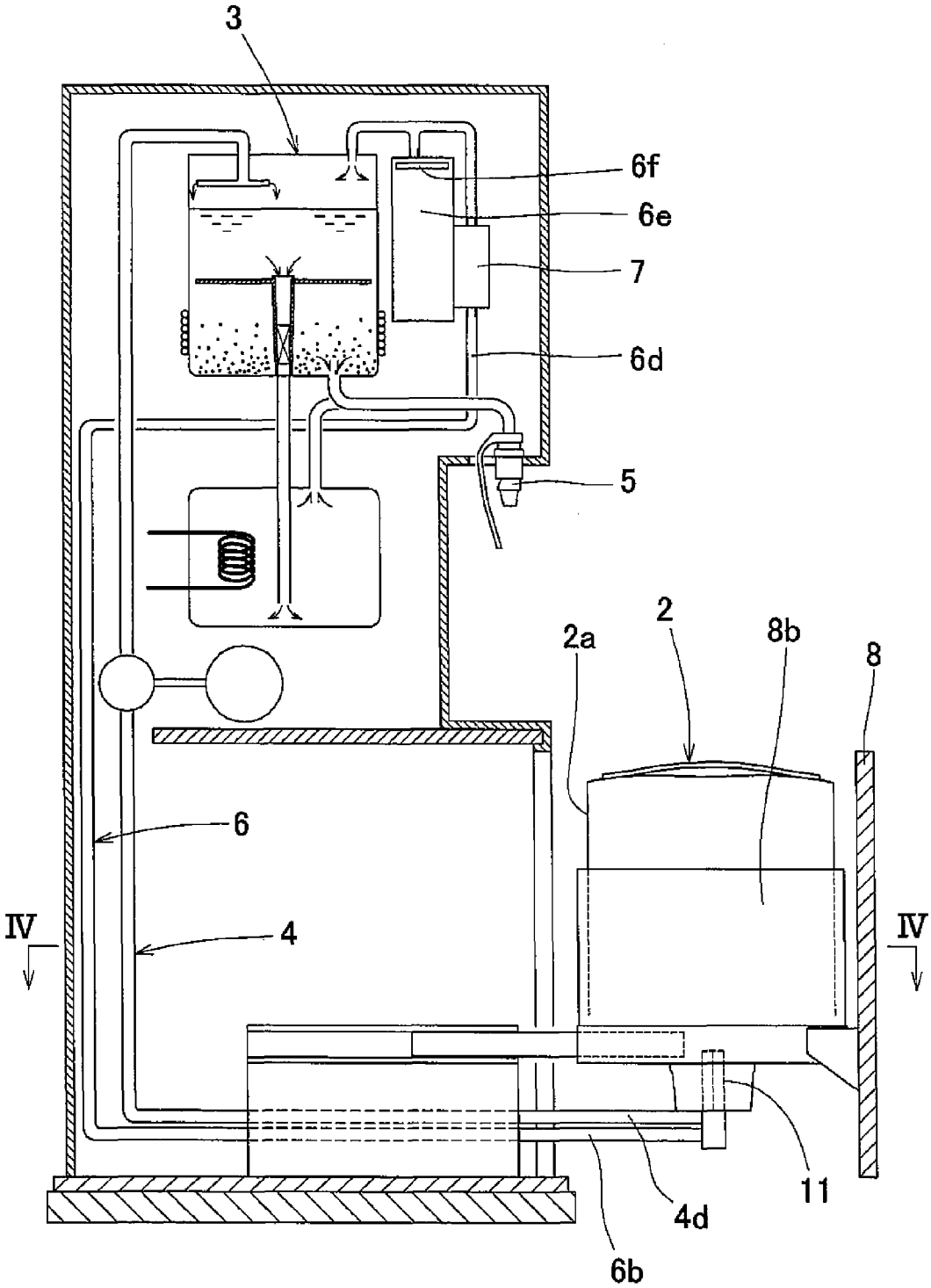
FIG. 2 schematically shows a state in which a slide table has been pulled out.
Figure 3:
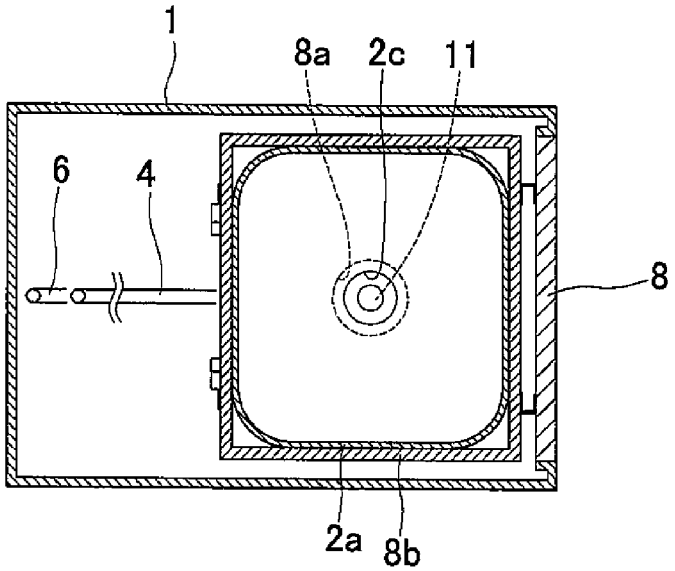
FIG. 3 is a sectional view taken along line III-III of FIG. 1.
Figure 4:
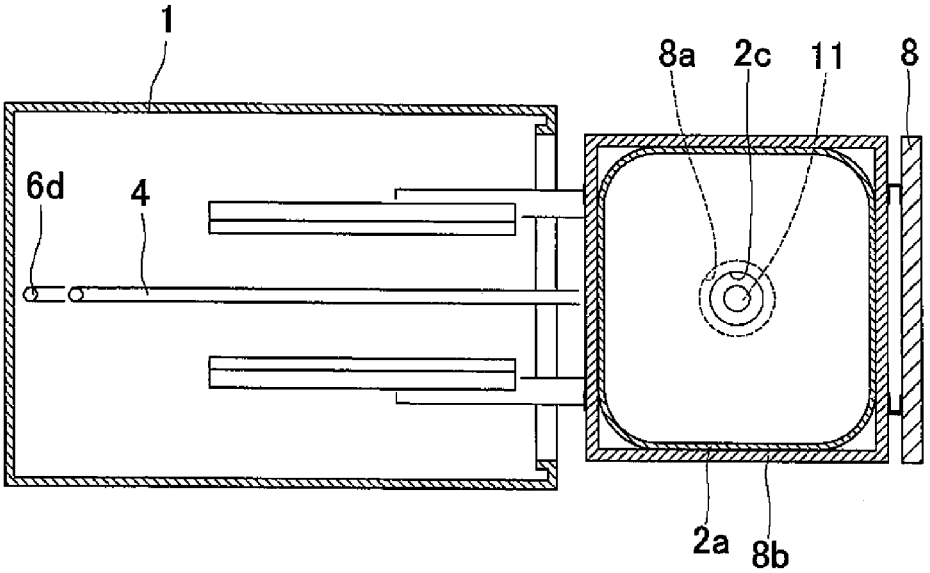
FIG. 4 is a sectional view taken along line IV-IV of FIG. 2.

From the state of FIGS. 1 and 3, in which the slide table 8 is in the housing 1, the slide table 8 is slid out of the housing 1 until the raw water container 2 is exposed as shown in FIGS. 2 and 4. In this state, the raw water container 2, which is now empty, is removed from the slide table 8, and a new sealed raw water container 2 filled with raw water is lifted to the position over the slide table 8 in the upside-down position, and lowered until the container 2 is opened by the piercing member 11 and the water supply line 4 and the air intake line 6 are connected to the raw water container 2. Since the new raw water container 2 has only to be lifted to a level of the slide table 8, which is located at the lower portion of the housing 1, the sealed container 2 is lifted only slightly and can be easily set in position. Once the raw water container 2 is connected to these lines, water in the container 2 flows not only into the water supply line 4 but also into the air intake line 6, through which the raw water container 2 is always in communication with the atmosphere. With the container 2 set in position, the slide table 8 is pushed into the lower portion of the housing 1 as shown in FIG. 1.

(Startup Procedure of the Water Dispenser)

When the pump 4*a* is switched on in the state of FIG. 1, the pump 4*a* begins to draw up water in the raw water container 2 into the water storage tank unit 3. When water level in the water storage tank unit 3 reaches the predetermined upper limit, the pump 4*a* is configured to be automatically switched off. While the water level in the water storage tank unit 3 is rising due to operation of the pump, air in the water storage tank unit 3 flows through the air introducing pipe 12 into the air chamber 6*e*, and is exhausted through the second end portion 6*f*. As water remaining in the raw water container 2 decreases, the raw water container 2 collapses and its volume decreases gradually. While the raw water container 2 is collapsing and its volume is decreasing, the container 2 helps the pump 4*a* to draw up water, thus reducing the load on the pump 4*a*. While the pump 4*a* is in operation, the amount of sterilizing gas in the vertically extending pipe 6*d* and in the air chamber 6*e* increases because the sterilizer 7 is activated while the pump 4*a* is operating. As the volume of the raw water container 2 decreases, the water level decreases from WL1 under the atmospheric pressure from outside. Water level in the vertically extending pipe 6*d* also decreases under the atmospheric pressure. When the water level in the water storage tank unit 3 reaches the predetermined upper limit, the pump 4*a* stops and so does the sterilizer 7. Simultaneously, the temperature adjusting function (heat exchanger 9 and heater 10) is automatically switched on. After exchanging containers 2, the amount of water drawn up from the container 2 until the water level in the water storage tank unit 3 first reaches the upper limit is sufficiently smaller than the amount of water contained in the sealed raw water container 2, so that the raw water container 2 is easily collapsible until the upper limit is reached. Thus, during this initial draw-up stage, no atmospheric air is sucked into the raw water container 2 through the air intake line 6, so that no air flows toward the vertically extending pipe 6*a* and further downstream.

(While Water is being Discharged from the Water Dispenser)

With the water level in the water storage tank unit 3 at the upper limit, when water in the water storage tank unit 3 (i.e. water in the cold water tank 3*a* or in the warm water tank 3*b*) is discharged through the water discharge line 5, the water level in the water storage tank unit 3 (which is the water level in the cold water tank 3*a*) falls, which causes atmospheric air in the air chamber 6*e*, which contains sterilizing gas, to be sucked into the upper portion of the water storage tank unit 3. This prevents growth of bacteria in the water storage tank unit 3. As long as raw water remains in the air intake line 6, no atmospheric air flow occurs in the vertically extending pipe 6*d* and further downstream.

(Replenishing Water into the Water Storage Tank Unit 3)

After water has been repeatedly discharged through the water discharge line 5, when the water level sensor detects that the water level in the water storage tank unit 3 has reached the lower limit, the pump 4*a* is automatically activated until the above-mentioned predetermined upper limit is reached again.

(When Air is Spontaneously Sucked into the Raw Water Container 2)

After repeatedly replenishing water into the tank unit, when the volume of the raw water container 2 decreases until the a peripheral wall portion 2*a* of the container 2 is bent in a complicated manner and as a result, its rigidity becomes higher than the atmospheric pressure, the container 2 reaches a point where its volume does not decrease any further. This state of the container 2 is shown by solid line in FIG. 5. The volume of the container 2 in this state is ordinarily ⅓ or less of the volume of the sealed container 2. After this state is reached, when water remaining in the raw water container 2 further decreases, a negative pressure is generated in the raw water container 2, so that atmospheric air is spontaneously sucked into the raw water container 2 through the air intake line 6 to offset the negative pressure in the raw water container 2.

(When Air is Spontaneously Sucked into the Raw Water Container 2 while the Pump 4*a* is Activated)

Figure 6:
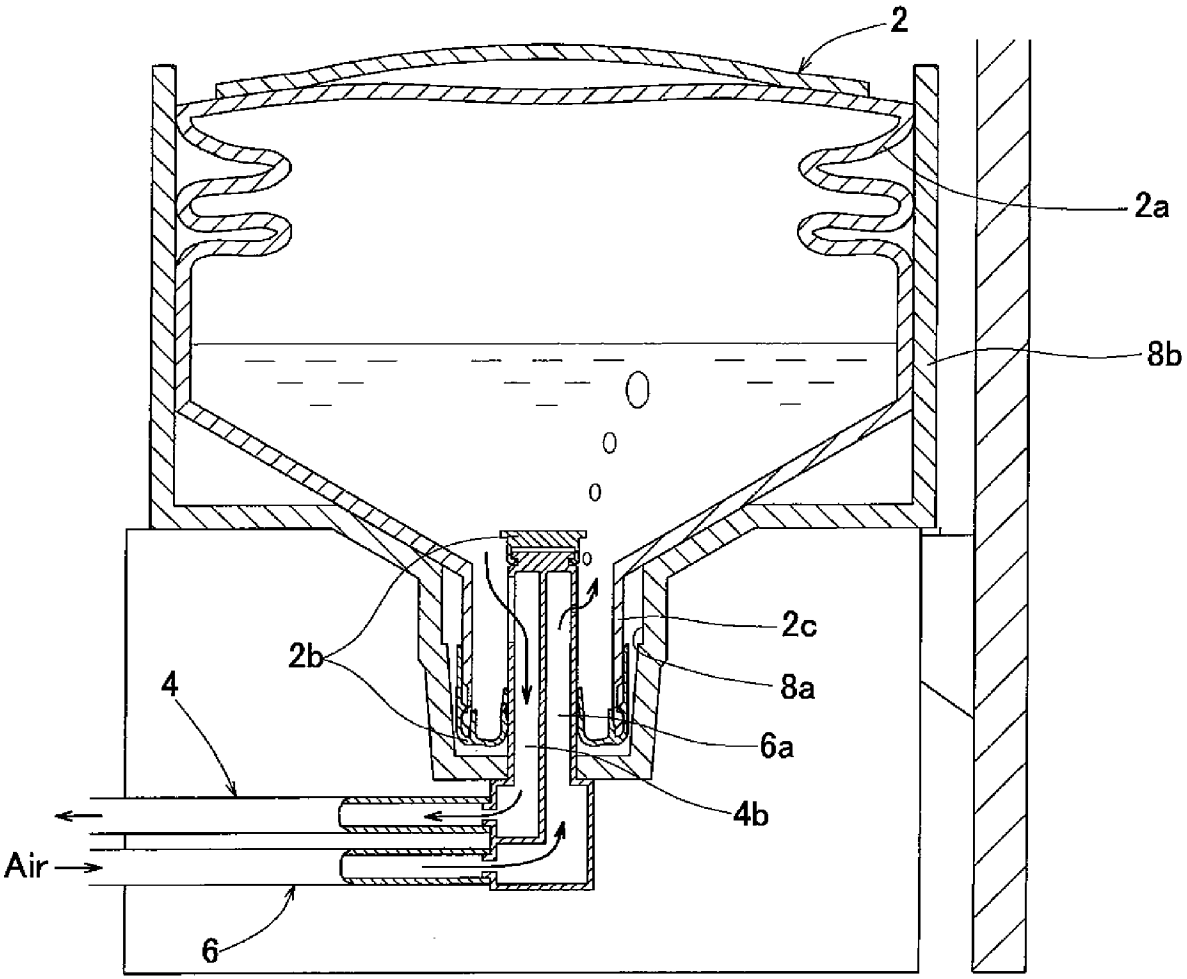
FIG. 6 shows how an air intake pipe of the embodiment operates.

FIG. 6 shows the state in which water is being replenished after the water remaining in the raw water container 2 has further decreased from the state of FIG. 5. In this state, even though the volume of the container 2 does not decrease, no undue load is applied to the pump 4*a* because air is spontaneously sucked into the raw water container 2 until the pressure in the raw material container 2 becomes equal to the atmospheric pressure. When atmospheric air is sucked into the raw water container 2 through the air intake line while the pump 4*a* is activated, atmospheric air containing sterilizing gas which flows from the water storage tank unit 3 through the air introducing pipe 12 into the vertically extending pipe 6*d* is mixed with atmospheric air containing sterilizing gas which flows from the air chamber 6 into the vertically extending pipe 6*d*, and the mixed air flows down the vertically extending pipe 6*d*. While flowing down the pipe 6*d*, sterilizing gas generated by the sterilizer 7 is further mixed into the mixed air. Thus atmospheric air sucked into the raw water container 2 contains sterilizing gas in high concentration. Such air can thus effectively prevent growth of bacteria in the raw material container 2 and in the vertically extending pipe 6*d* and the portions of the lines downstream of the pipe 6*d*, which tend to become wet. As shown in FIG. 6, atmospheric air bubbles that are sucked into the raw water container 2 rise in the raw water container 2 and stay in the space in the container 2. By preventing air bubbles rising in the container 2 from being sucked into the water supply line 4, it becomes possible to draw up water more efficiently. As shown in FIG. 6, by providing the opening of the first end portions 4*b* of the water supply line 4 at a diametrically opposite position of the piercing member 11 from the opening of the first end portion 6*a* of the air intake line 6 so that these openings face away from each other, it is possible to prevent bubbles in the container 2 from being sucked into the water supply line 4.

(When Air is Spontaneously Sucked into the Raw Water Container 2 while the Pump 4*a* is not Activated)

Even while the pump 4*a*, shown in FIG. 1, is not activated, if any physical change occurs that tends to generate a negative pressure in the raw water container 2, such as fluctuations in ambient temperature, atmospheric air in the water storage tank unit 3 and in the air chamber 6*e* will be sucked into the raw water container 2. However, since the sterilizer 7 is not activated, no high sterilizing effect can be expected.

(When the Raw Water Container 2 has Become Empty)

When the water level in the raw water container 2 reaches WL2 (see FIG. 5), the raw water container 2 is considered to be practically empty. This water dispenser includes a sensor which can detect that the container 2 has become empty, and is configured such that after the sensor detects that the container 2 has become practically empty, the pump 4*a* and the sterilizer 7, shown in FIG. 1, are operated for a predetermined period of time, as measured by a timer. During this predetermined time period, atmospheric air containing sterilizing gas flows through and sterilizes the circulating path extending from the air intake line 6 to the air chamber 6*e* through the raw water container 2, water supply line 4 and water storage tank unit 3. The water dispenser is further configured to notify a user that it is necessary to exchange the raw water container 2, by e.g. turning on a light, when the sensor detects that the container 2 has become empty.

This invention is not limited to the above-described embodiments, but various modifications are possible within the scope of the claims. For example, since collapsibility of the raw water container under the atmospheric pressure is correlated to such parameters as the load on the pump and water remaining in the container, the pump may be controlled in operative association with the control of an on-off valve for the air intake line based on e.g. a sensor and a pump operation history such that the raw water container is brought into communication with the atmosphere through the air intake line only when necessary, thereby improving hygiene.

What is claimed is:

1. A water dispenser comprising:

a housing having a lower portion;

an exchangeable raw water container which has a plug and which can be set at the lower portion of the housing in an upside-down position;

a water storage tank mounted in the housing at a position higher than the raw water container set at the lower portion of the housing in the upside-down position;

a water supply line through which water in the raw water container, set at the lower portion of the housing in the upside-down position can be drawn up into the water storage tank by a pump;

a water discharge line through which water in the water storage tank can be discharged;

a piercing member configured to push up the plug of the raw water container when the raw water container is placed at the lower portion of the housing in the upside-down position;

an air intake line through which atmospheric air can be freely sucked into the raw water container, set at the lower portion of the housing in the upside-down position, while the pump is activated;

a sterilizer provided in the air intake line and configured to mix sterilizing gas into atmospheric air in the air intake line, wherein the sterilizer is operatively associated with the pump; and an air chamber, wherein the air chamber is connected to the water storage tank through an air introducing pipe, wherein the water supply line has an end portion which is a portion of the piercing member, wherein the air intake line has a first end portion and a second end portion, wherein the second end portion of the air intake line constitutes an atmospheric air intake port of the air chamber, wherein the first end portion of the air intake line constitutes a portion of the piercing member such that, with the raw water container set at the lower portion of the housing in the upside-down position, the air intake line maintains the raw water container in communication with the atmosphere, wherein the raw water container is made of a soft material and has a portion which is collapsible under an atmospheric pressure when water remaining in the raw water container decreases, and wherein a portion of the air intake line is constituted by an upwardly extending pipe through which atmospheric air flows downwardly toward the first end portion of the air intake line, and the sterilizer is configured to mix sterilizing gas in the air chamber and to mix sterilizing gas with the atmospheric air to flow with the atmospheric air downwardly through the upwardly extending pipe toward the first end portion of the air intake line.

2. The water dispenser of claim 1, wherein the air intake line includes a copper pipe portion configured such that, with the raw water container set at the lower portion of the housing in the upside-down position, a water level in the copper pipe portion becomes equal to a water level in the raw water container.

* * * * *